US010323464B1

(12) United States Patent
Al-AbdulJabbar

(10) Patent No.: US 10,323,464 B1
(45) Date of Patent: Jun. 18, 2019

(54) WELLBORE DRILL BIT NOZZLE

(71) Applicant: Saudi Arabian Oil Company, Dhahran (SA)

(72) Inventor: Ahmad Mohammad Al-AbdulJabbar, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 78 days.

(21) Appl. No.: 15/944,957

(22) Filed: Apr. 4, 2018

(51) Int. Cl.
*E21B 10/61* (2006.01)
*E21B 10/60* (2006.01)
*E21B 21/00* (2006.01)

(52) U.S. Cl.
CPC ..... *E21B 10/61* (2013.01); *E21B 10/602* (2013.01); *E21B 21/003* (2013.01)

(58) Field of Classification Search
CPC ..... E21B 10/61; E21B 10/602
USPC ..... 175/72
See application file for complete search history.

(56) References Cited

U.S. PATENT DOCUMENTS

| | | | | |
|---|---|---|---|---|
| 3,645,331 | A * | 2/1972 | Maurer | E21B 7/18 138/42 |
| 6,227,316 | B1 * | 5/2001 | Rohde | E21B 10/18 175/340 |
| 6,848,517 | B2 | 2/2005 | Wardley | |
| 7,395,882 | B2 | 7/2008 | Oldham et al. | |
| 2009/0056952 | A1 | 3/2009 | Churchill | |

* cited by examiner

*Primary Examiner* — William D Hutton, Jr.
*Assistant Examiner* — Ashish K Varma
(74) *Attorney, Agent, or Firm* — Fish & Richardson P.C.

(57) ABSTRACT

A wellbore drill bit assembly includes a drill bit that includes a drilling fluid pathway that has an inlet fluidly connected to a drilling fluid entrance of the drill bit and an outlet fluidly connected to a drilling fluid exit of the drill bit; and a nozzle positioned in the drilling fluid pathway, where at least a portion of the nozzle includes a removable material configured to dissolve or erode in contact with a drilling fluid additive.

16 Claims, 3 Drawing Sheets

WELLBORE DRILL BIT NOZZLE

TECHNICAL FIELD

This disclosure relates to a nozzle for a wellbore drill bit.

BACKGROUND

During drilling operations, a drilling fluid may be "lost" to the formation due to instability or other issues with the formation that surrounds the wellbore. In some cases, a heavy lost circulation material (LCM) is added to the drilling fluid to help stop the loss of drilling fluid to the formation. Often, the losses must be cured before pulling out of the well and running back into the well with another bottom hole assembly (BHA) such as an open ended pipe to spot cement, for example. Alternatively, the well section can be drilled with losses (e.g., blindly); however once the drill bit reaches a target depth, these losses must be cured before pulling out of the hole to run casing. The current practice involves pumping small concentrations of the LCM through a nozzle of the drill bit until the losses are cured completely or tripping out of hole if allowed. This results in spending tremendous amount of time, money and drilling fluid volumes. In some aspects, a drill bit nozzle may not be sufficient enough to efficiently pump the LCM through it to cure losses.

SUMMARY

In an example implementation, a wellbore drill bit assembly includes a drill bit that includes a drilling fluid pathway that includes an inlet fluidly connected to a drilling fluid entrance of the drill bit and an outlet fluidly connected to a drilling fluid exit of the drill bit; and a nozzle positioned in the drilling fluid pathway, at least a portion of the nozzle including a removable material configured to dissolve or erode in contact with a drilling fluid additive.

In an aspect combinable with the example implementation, the drilling fluid pathway includes a first diameter portion defined by a first diameter and a second diameter portion defined by a second diameter.

In another aspect combinable with any one of the previous aspects, the second diameter is larger than the first diameter.

In another aspect combinable with any one of the previous aspects, the first diameter portion includes the inlet, and the second diameter portion includes the outlet.

In another aspect combinable with any one of the previous aspects, the second diameter portion includes a grooved surface configured to receive a threaded portion of the nozzle.

In another aspect combinable with any one of the previous aspects, the nozzle includes a threaded portion and a venturi portion.

In another aspect combinable with any one of the previous aspects, the threaded portion includes the removable material.

In another aspect combinable with any one of the previous aspects, the venturi portion includes the outlet.

In another aspect combinable with any one of the previous aspects, the removable material includes at least one of a metal alloy or a plastic material.

In another aspect combinable with any one of the previous aspects, the metal alloy includes at least one of magnesium or aluminum.

In another aspect combinable with any one of the previous aspects, the drilling fluid additive includes at least one of an acid, a brine, or a chloride fluid.

In another example implementation, a wellbore drill bit nozzle includes a body including an outer surface configured to mate with a portion of a drill bit; and a bore that extends through the body, the bore including an inlet and an outlet, where at least a portion of the body includes a removable material configured to dissolve or erode in contact with a drilling fluid additive.

In an aspect combinable with the example implementation, the body includes a threaded portion and a venturi portion, the bore extending through the threaded and venture portions.

In another aspect combinable with any one of the previous aspects, at least one of the threaded portion or the venturi portion includes the removable material.

In another aspect combinable with any one of the previous aspects, the bore includes a first diameter adjacent the threaded portion and a second diameter adjacent the venturi portion, the second diameter smaller than the first diameter.

In another aspect combinable with any one of the previous aspects, the removable material includes at least one of a metal alloy or a plastic material.

In another aspect combinable with any one of the previous aspects, the metal alloy includes at least one of magnesium or aluminum.

In another aspect combinable with any one of the previous aspects, the drilling fluid additive includes at least one of an acid, a brine, or a chloride fluid.

In another example implementation, a method for adjusting a flow of a drilling fluid includes circulating a drilling fluid in a tubular to a wellbore drill bit that includes a nozzle positioned in a drilling fluid pathway of the drill bit; circulating the drilling fluid through the drilling fluid pathway and through the nozzle; adding a drilling fluid additive to the drilling fluid; circulating the drilling fluid and the drilling fluid additive through the drilling fluid pathway and through the nozzle; and removing, with the drilling fluid additive, at least a portion of the nozzle that includes a removable material.

In an aspect combinable with the example implementation, the nozzle includes a threaded portion and a venturi portion positioned inside of the threaded portion.

In another aspect combinable with any one of the previous aspects, removing, with the drilling fluid additive, at least the portion of the nozzle that includes the removable material includes removing at least a portion of the venturi portion.

Another aspect combinable with any one of the previous aspects further includes circulating the drilling fluid through the drilling fluid pathway and through the threaded portion of the nozzle; adding a lost circulation material to the drilling fluid; and circulating the drilling fluid and the lost circulation material through the drilling fluid pathway and through the threaded portion of the nozzle.

In another aspect combinable with any one of the previous aspects, the removable material includes at least one of a metal alloy or a plastic material.

In another aspect combinable with any one of the previous aspects, the metal alloy includes at least one of magnesium or aluminum.

In another aspect combinable with any one of the previous aspects, the drilling fluid additive includes at least one of an acid, a brine, or a chloride fluid.

Implementations of a wellbore drill bit nozzle according to the present disclosure may include one or more of the following features. For example, the wellbore drill bit nozzle may have an adjustable flow path dimension, such as diameter, to allow for lost circulation material to be circulated through it depending on drilling operations. The wellbore drill bit nozzle may have an adjustable flow path dimension that is adjustable without tripping the wellbore drill bit out of the wellbore. As another example, the wellbore drill bit nozzle flow path dimension may be adjustable by circulating a drilling fluid additive or a certain activation fluid into the wellbore drill bit.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
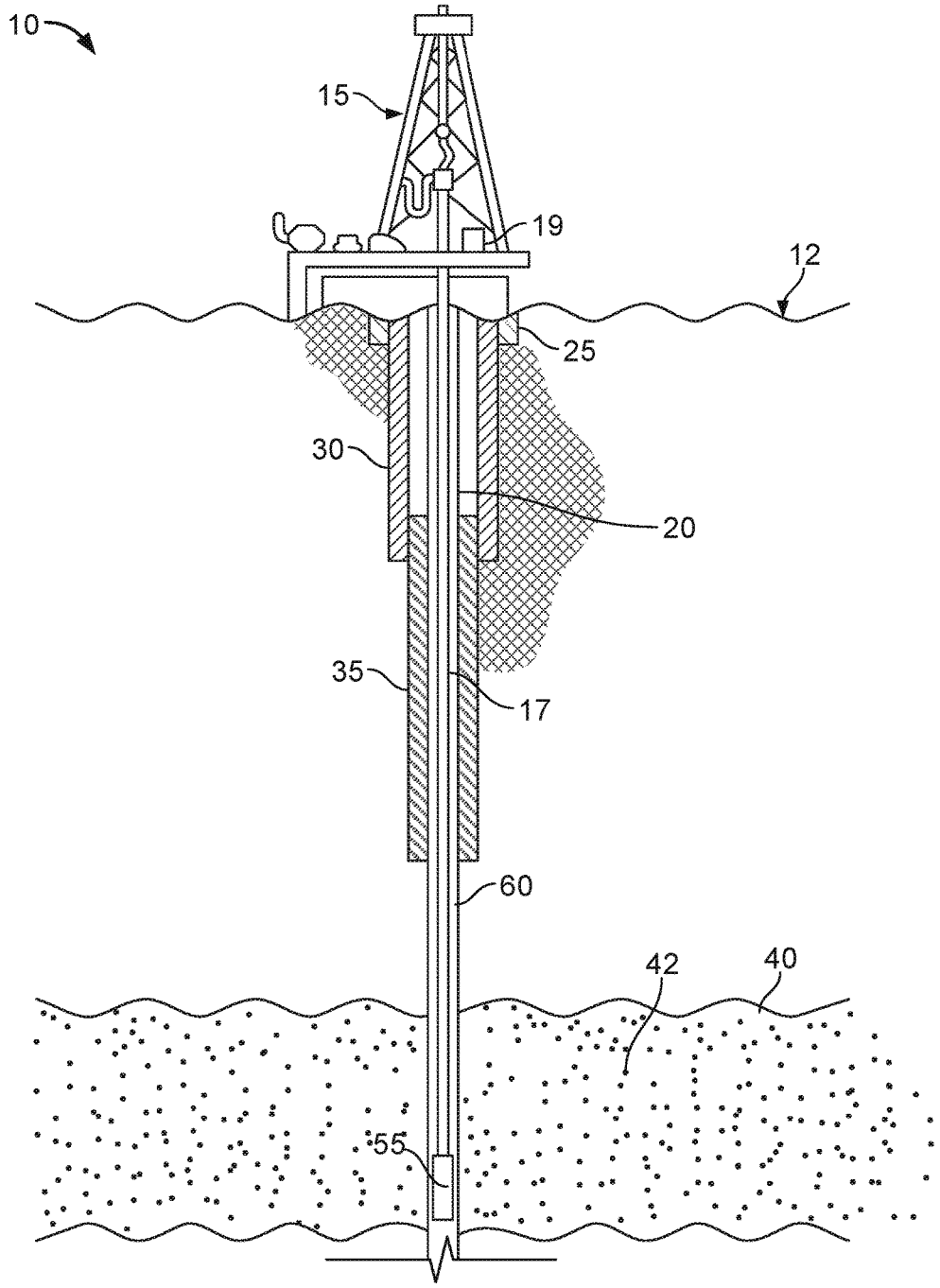
FIG. 1 is a schematic diagram of an example wellbore system that includes a wellbore drill bit nozzle according to the present disclosure.

FIG. 1 is a schematic diagram of an example wellbore system 10 that includes a wellbore drill bit nozzle according to the present disclosure. Generally, FIG. 1 illustrates a portion of one embodiment of a wellbore system 10 according to the present disclosure in which a wellbore drill bit ("drill bit") includes a nozzle to receive and, in some aspects, accelerate a flow rate velocity of a drilling fluid used during drilling operations. The nozzle, as described more fully in the present disclosure, includes one or more portions comprised of a dissolvable, erodible, or otherwise removable material (for example, removable in situ in the wellbore without tripping out of the wellbore). In some aspects, when placed in contact with a dissolving fluid (for example, within the drilling fluid), the dissolvable material may dissolve (at least partially), or otherwise erode from the nozzle.

As shown, the wellbore system 10 accesses a hydrocarbon bearing rock formation 42 of a subterranean formations 40, and provides access to hydrocarbons located in such subterranean formation 40. In an example implementation of system 10, the system 10 may be used for a drilling operation in which a downhole tool 55 may include or be coupled with a drill bit. As illustrated in FIG. 1, an implementation of the wellbore system 10 includes a drilling assembly 15 deployed on a terranean surface 12. The drilling assembly 15 may be used to form a wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20.

In some embodiments, the drilling assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the drilling assembly 15 may be any appropriate assembly or drilling rig used to form wellbores or boreholes in the Earth. The drilling assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string 17 and the downhole tool 55 (for example, a bottom hole assembly and bit). In some embodiments, the drilling assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string 17. The drill string 17 is typically attached to the drill bit within the downhole tool 55 (for example, bottom hole assembly). A swivel, which is attached to hoisting equipment, carries much, if not all of, the weight of the drill string 17, but may allow it to rotate freely.

The drill string 17 typically consists of sections of heavy steel pipe, which are threaded so that they can interlock together. Below the drill pipe are one or more drill collars, which are heavier, thicker, and stronger than the drill pipe. The threaded drill collars help to add weight to the drill string 17 above the drill bit to ensure that there is enough downward force on the drill bit to allow the bit to drill through the one or more geological formations. The number and nature of the drill collars on any particular rotary rig may be altered depending on the downhole conditions experienced while drilling.

The circulating system of a rotary drilling operation, such as the drilling assembly 15, may be an additional component of the drilling assembly 15. Generally, the circulating system may cool and lubricate the drill bit, removing the cuttings from the drill bit and the wellbore 20 (for example, through an annulus 60), and coat the walls of the wellbore 20 with a mud type cake. The circulating system consists of drilling fluid, which is circulated down through the wellbore throughout the drilling process. Typically, the components of the circulating system include drilling fluid pumps, compressors, related plumbing fixtures, and specialty injectors for the addition of additives to the drilling fluid. In some embodiments, such as, for example, during a horizontal or directional drilling process, downhole motors may be used in conjunction with or in the downhole tool 55. Such a downhole motor may be a mud motor with a turbine arrangement, or a progressive cavity arrangement, such as a Moineau motor. These motors receive the drilling fluid through the drill string 17 and rotate to drive the drill bit or change directions in the drilling operation.

In many rotary drilling operations, the drilling fluid is pumped down the drill string 17 and out through ports or jets in the drill bit. The fluid then flows up toward the surface 12 within annulus 60 between the wellbore 20 and the drill string 17, carrying cuttings in suspension to the surface. The drilling fluid, much like the drill bit, may be chosen depending on the type of geological conditions found under subterranean surface 12.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

In some aspects, the drilling assembly 15 (or other portion of the well system 10) may include a control system 19, for example, microprocessor-based, electro-mechanical, or otherwise, that may control the downhole tool 55 including the drill bit. In some aspects, the control system 19 may control one or more pumps, one or more valves, as well as other equipment that is part of or connected to the drilling fluid circulation system. For example, the control system 19 may control a flow rate, pressure, or other circulation criteria of the drilling fluid. In some aspects, the control system 19 may also control a composition of the drilling fluid, such as, a water percentage of the fluid, or an additive that may be mixed with the drilling fluid.

Figure 2:
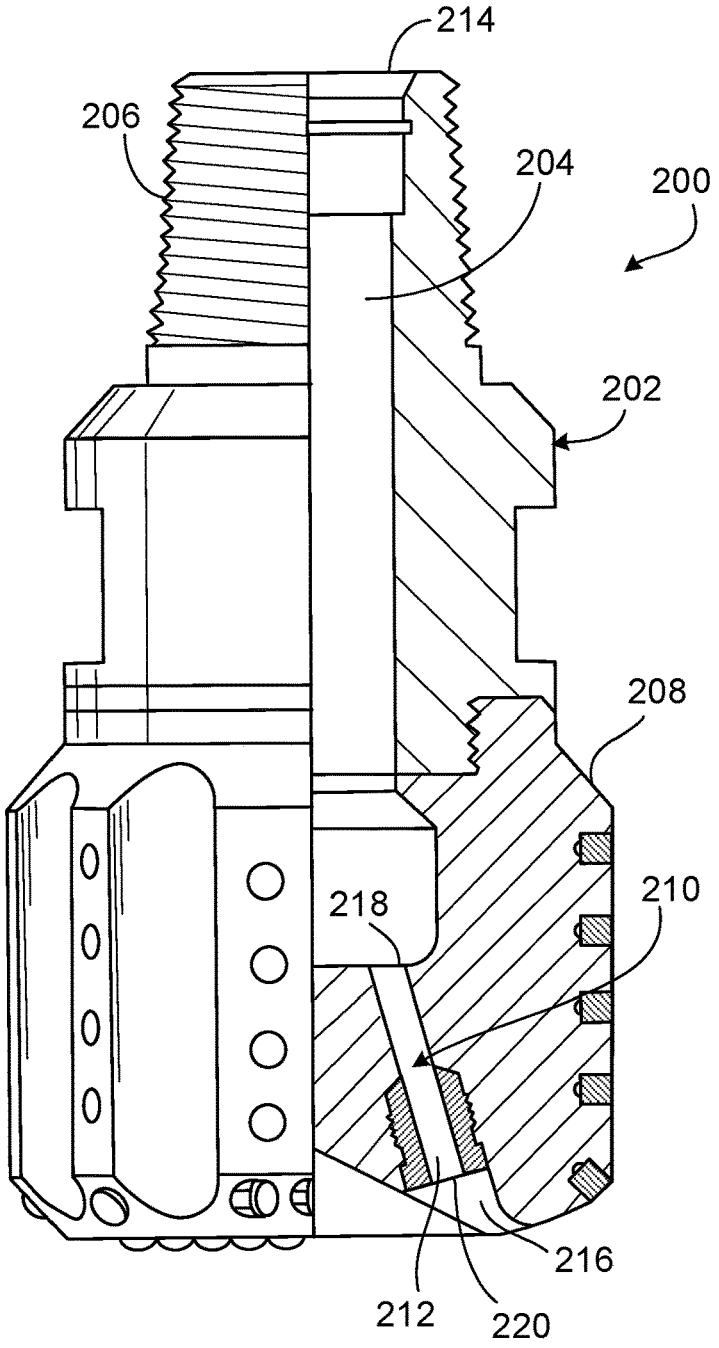
FIG. 2 is a schematic, partial cross-sectional diagram of a wellbore drill bit that includes a wellbore drill bit nozzle according to the present disclosure.

FIG. 2 is a schematic, partial cross-sectional diagram of a wellbore drill bit 200 that includes a wellbore drill bit nozzle 212. In some aspects, the wellbore drill bit 200 may be part of the downhole tool 55 (for example, a bottom hole assembly or BHA) that is shown in FIG. 1. As shown in FIG. 2, the wellbore drill bit 200, generally, includes a body 202 that is made up of a top portion 206 and a bit portion 208. The top portion 206, for example, provides a connection mechanism (for example, threads or otherwise) to a downhole work string or tool, such as a BHA. The bit portion 208, generally, includes multiple cutting locations that, when the wellbore drill bit 200 is rotated on the drilling string, crushes, cuts, or otherwise removes portions of a rock formation to form a wellbore. The wellbore drill bit 200 may be, for example, a steel tooth rotary bit, an inert bit having tungsten carbide inserts, a polycrystalline diamond compact (PDC) bit, or a bit that is a hybrid of many types of bits.

The wellbore drill bit 200 includes a drilling fluid bore 204 that has an entrance 214 at a top edge of the top portion 206 and an exit 218 within the bit portion 208 of the body 202. The bore 204 receives a flow of drilling fluid during drilling operations and directs the drilling fluid from the entrance 214, through the body 202, and to a fluid inlet 218 of a drilling fluid pathway 210 as shown. An exit 216 of the bore 204 is located on an opposite end of the fluid pathway 210 as the entrance 214.

As shown, a nozzle 212 is mounted in the fluid pathway 210 between the fluid inlet 218 and a fluid outlet 220 of the pathway 210. Generally, the nozzle 212 receives and accelerates a flow of the drilling fluid received into the wellbore drill bit 200 during drilling operations. At an increased velocity from the nozzle 212 (and from the wellbore drill bit 200 itself through exit 216), the drilling fluid may better remove and entrain rock cuttings produced by the wellbore drill bit 200 so such particles can be circulated to the surface.

The nozzle 212, in some aspects, as an adjustable orifice size as described with reference to FIGS. 3A-3C. Thus, in some aspects, the nozzle 212 may produce a drilling fluid exit velocity designed for typical or normal drilling operations with an original bore size (for example, bore diameter). The nozzle 212 may also produce a drilling fluid exit velocity designed for lost circulation operations with an adjusted bore size (for example, bore diameter) that is larger than the original bore size to accommodate lost circulation material added to the drilling fluid. The adjustment from the original bore size to the adjusted, larger bore size of the nozzle 212 may occur, for example, through dissolution, erosions, or otherwise removal of at least a portion of the nozzle 212 through an additive to the drilling fluid that is chemically designed to dissolve, erode, or otherwise remove that portion of the nozzle 212.

Figure 3C:
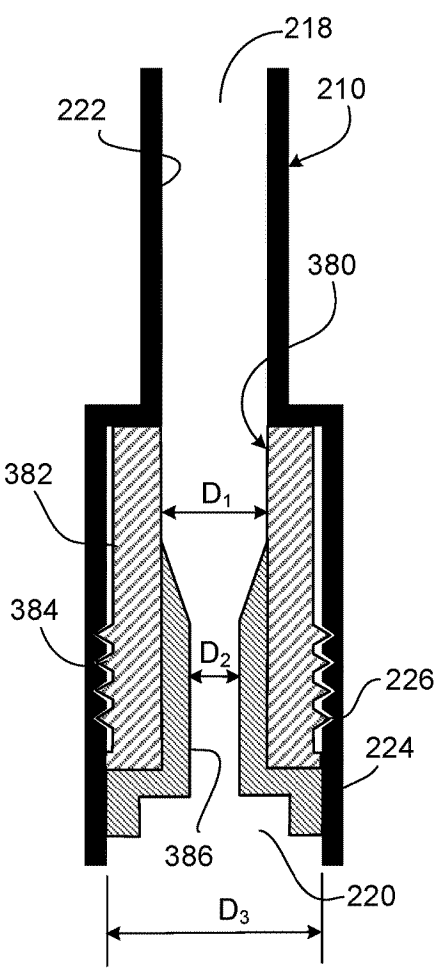
FIG. 3C is a schematic diagram of another example implementation of a wellbore drill bit nozzle according to the present disclosure.
Figure 3B:
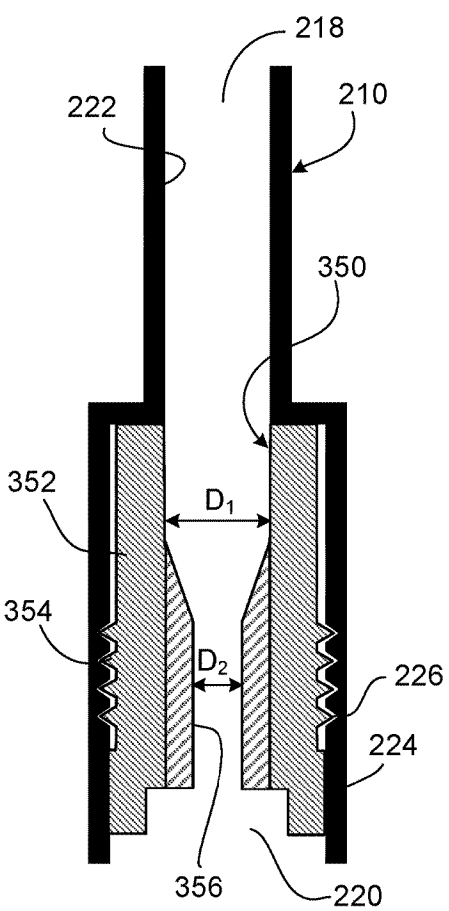
FIG. 3B is a schematic diagram of another example implementation of a wellbore drill bit nozzle according to the present disclosure.
Figure 3A:
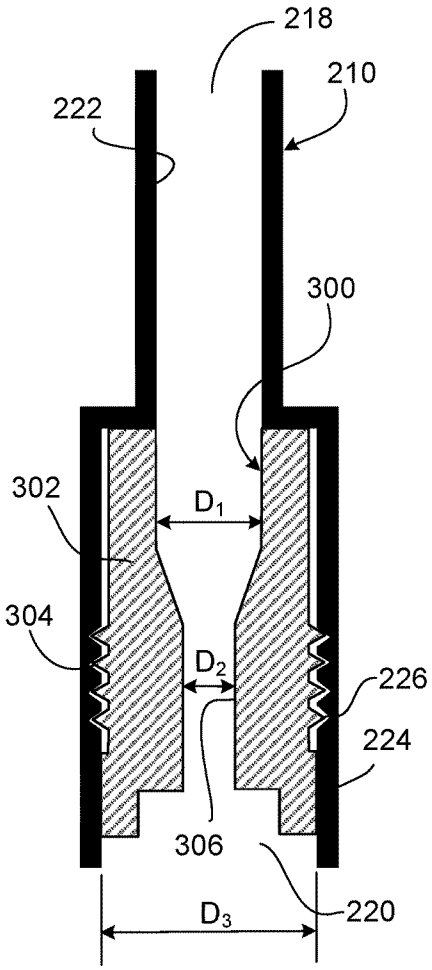
FIG. 3A is a schematic diagram of an example implementation of a wellbore drill bit nozzle according to the present disclosure.

FIG. 3A is a schematic diagram of an example implementation of a wellbore drill bit nozzle 300. In some aspects, the nozzle 300 may be the same as or used as the nozzle 212 shown in the wellbore drill bit 200 of FIG. 2. As shown in FIG. 3A, the nozzle 300 is shown mounted in the fluid pathway 210, which includes the fluid inlet 218 and the fluid outlet 220. As shown in this example, the fluid pathway 210 includes a first portion 222 and a second portion 224, with the second portion 224 being larger (for example, greater diameter measurement) than the first portion 222. In this example, the nozzle 300 is mounted in the second, larger portion 224 of the fluid pathway 210.

As shown in this example, the nozzle 300 includes threads 304 that mate (for example, through rotation) with grooves 226 formed in the second portion 224 of the fluid pathway 210. Thus, in this example, the nozzle 300 is connected to the fluid pathway 210 (and the wellbore drill bit 200) through a threaded connection. In alternative implementations, the nozzle 300 may be press fit into the fluid pathway 210 to remain due to a friction interface between the nozzle 300 and the second portion 224 of the fluid pathway 210.

As shown in this example, the nozzle 300 comprises a venturi shape in which a threaded portion 302 surrounds a venturi portion 306. The threaded portion 302 includes the threads 304 and provides an interface between the venturi portion 306 and the fluid pathway 210. As shown in this example, the threaded portion 302 has a diameter, $D_1$, that is larger than a diameter, $D_2$, of the venturi portion 306.

In this example implementation, all of the nozzle 300 may be made from or comprise a material that, when contacted by a particular additive of the drilling fluid, may dissolve, erode, or otherwise be removed into the drilling fluid by the additive. Thus, in some example, during normal drilling operations, drilling fluid circulated through the nozzle 300 may be circulated through a cross-sectional area of the first portion 222 and the threaded portion 302 that is defined by $D_1$. The drilling fluid then circulates through a cross-sectional area of the venturi portion 306 that is defined by $D_2$ to increase in velocity. During a lost circulation operation, in which lost circulation material is added to the drilling fluid, and subsequent to dissolution, erosion, or otherwise removal of the whole nozzle 300, drilling fluid with lost circulation material is circulated through the cross-sectional area of the first portion 222 and then a cross-sectional area of the second portion 224 of the fluid pathway 210 that is defined by a diameter, $D_3$. As shown, $D_3$ is larger than $D_1$ and $D_2$. Therefore, while the drilling fluid exit velocity decreases, the lost circulation material added to the drilling fluid better and more easily exits the wellbore drill bit 200 (relative to the nozzle 350 prior to dissolution, erosion, or removal of the nozzle 300).

Example materials for the nozzle 300 may include metal alloys or plastics. Metal alloys may include, for example, magnesium, aluminum, or other metals that may dissolve or erode in the presence of, for example, acid as an additive to the drilling fluid. Other example additives include brine, potassium chloride, or other high chloride liquids. In some aspects, the choices of nozzle material and additive may be selected so that contact between nozzle material and drilling fluid additive creates a Galvanic reaction or otherwise causes rapid dissolution of the material.

In some aspects, the nozzle 300 shown in FIG. 3A may be used in relatively shallow wellbores or in wellbores where low drilling fluid solids are used. For example, this nozzle 300 may prevent too quickly removing the material and may allow quickly dissolving the martial since all the nozzle body is removable. In some aspects, the nozzle 300, which is completely dissolvable, erodible, or otherwise removable, may be a default choice for drilling operations. Thus, if a wellbore being formed experiences losses, and a high LCM concentration needs to be pumped (along with the drilling fluid) down the drilling string without plugging the nozzle 300, an activation fluid can be pumped within the drilling fluid (or by itself) to dissolve the entire nozzle 300.

FIG. 3B is a schematic diagram of another example implementation of a wellbore drill bit nozzle 350. In some aspects, the nozzle 350 may be the same as or used as the nozzle 212 shown in the wellbore drill bit 200 of FIG. 2. As shown in FIG. 3B, the nozzle 350 is shown mounted in the fluid pathway 210, which includes the fluid inlet 218 and the fluid outlet 220. As shown in this example, the fluid pathway 210 includes a first portion 222 and a second portion 224, with the second portion 224 being larger (for example, greater diameter measurement) than the first portion 222. In this example, the nozzle 350 is mounted in the second, larger portion 224 of the fluid pathway 210.

As shown in this example, the nozzle 350 includes threads 354 that mate (for example, through rotation) with grooves 226 formed in the second portion 224 of the fluid pathway 210. Thus, in this example, the nozzle 350 is connected to the fluid pathway 210 (and the wellbore drill bit 200) through a threaded connection. In alternative implementations, the nozzle 350 may be press fit into the fluid pathway 210 to remain due to a friction interface between the nozzle 350 and the second portion 224 of the fluid pathway 210.

As shown in this example, the nozzle 350 comprises a venturi shape in which a threaded portion 352 surrounds a venturi portion 356. The threaded portion 352 includes the threads 354 and provides an interface between the venturi portion 356 and the fluid pathway 210. As shown in this example, the threaded portion 352 has a diameter, $D_1$, that is larger than a diameter, $D_2$, of the venturi portion 356.

In this example implementation, the venturi portion 356 of the nozzle 350 may be made from or comprise a material that, when contacted by a particular additive of the drilling fluid, may dissolve, erode, or otherwise be removed into the drilling fluid by the additive. Thus, in some example, during normal drilling operations, drilling fluid circulated through the nozzle 350 may be circulated through a cross-sectional area of the first portion 222 and the threaded portion 352 that is defined by $D_1$. The drilling fluid then circulates through a cross-sectional area of the venturi portion 356 that is defined by $D_2$ to increase in velocity. During a lost circulation operation, in which lost circulation material is added to the drilling fluid, and subsequent to dissolution, erosion, or otherwise removal of the venturi portion 356, drilling fluid with lost circulation material is circulated through the cross-sectional area of the first portion 222 and then a cross-sectional area of the threaded portion 352 of the nozzle 350, both of which being defined by the diameter, $D_1$. As shown, $D_1$ is larger than $D_2$. Therefore, while the drilling fluid exit velocity decreases, the lost circulation material added to the drilling fluid better and more easily exits the wellbore drill bit 200 (relative to the nozzle 350 prior to dissolution, erosion, or removal of the venturi portion 356).

Example materials for the venturi portion 356 may include metal alloys or plastics. Metal alloys may include, for example, magnesium, aluminum, or other metals that may dissolve or erode in the presence of, for example, acid as an additive to the drilling fluid. Other example additives include brine, potassium chloride, or other high chloride liquids. In some aspects, the choices of nozzle material and additive may be selected so that contact between nozzle material and drilling fluid additive creates a Galvanic reaction or otherwise causes rapid dissolution of the material.

In some aspects, the nozzle 350 shown in FIG. 3B may be used in relatively shallow wellbores or in wellbores where low drilling fluid solids are used. For example, having the venturi portion 356 be removable may prevent eroding the nozzle 350 too quickly in case there is a concern about pumping too many additive down the drill string (for example, due to a concern of pumping too much acid into an acid-reactive formation). In some aspects, an activation fluid that is circulated (for example, along with a drilling fluid) to dissolve, erode, or otherwise remove at least a portion of nozzle 350 may react in undesirable ways with a geological formation adjacent the wellbore being formed. For example, if acid is the activation fluid, it may damage the formation. Further, in such cases, it may be desirable to quickly dissolve, erode, or otherwise remove at least a portion of nozzle 350. In such cases, having the venturi portion 356 be removable, as the smaller of the two portions of the nozzle 350, may speed up the removing process and reduce the activation fluid amount necessary to remove the portion of the nozzle 300.

FIG. 3C is a schematic diagram of another example implementation of a wellbore drill bit nozzle 380. In some aspects, the nozzle 380 may be the same as or used as the nozzle 212 shown in the wellbore drill bit 200 of FIG. 2. As shown in FIG. 3C, the nozzle 380 is shown mounted in the fluid pathway 210, which includes the fluid inlet 218 and the fluid outlet 220. As shown in this example, the fluid pathway 210 includes a first portion 222 and a second portion 224, with the second portion 224 being larger (for example, greater diameter measurement) than the first portion 222. In this example, the nozzle 380 is mounted in the second, larger portion 224 of the fluid pathway 210.

As shown in this example, the nozzle 380 includes threads 384 that mate (for example, through rotation) with grooves 226 formed in the second portion 224 of the fluid pathway 210. Thus, in this example, the nozzle 380 is connected to the fluid pathway 210 (and the wellbore drill bit 200) through a threaded connection. In alternative implementations, the nozzle 380 may be press fit into the fluid pathway 210 to remain due to a friction interface between the nozzle 380 and the second portion 224 of the fluid pathway 210.

As shown in this example, the nozzle 380 comprises a venturi shape in which a threaded portion 382 surrounds a venturi portion 386. The threaded portion 382 includes the threads 384 and provides an interface between the venturi portion 386 and the fluid pathway 210. As shown in this example, the threaded portion 382 has a diameter, $D_1$, that is larger than a diameter, $D_2$, of the venturi portion 386.

In this example implementation, the threaded portion 382 of the nozzle 380 may be made from or comprise a material that, when contacted by a particular additive of the drilling fluid, may dissolve, erode, or otherwise be removed into the drilling fluid by the additive. Thus, in some example, during normal drilling operations, drilling fluid circulated through the nozzle 380 may be circulated through a cross-sectional area of the first portion 222 and the threaded portion 382 that is defined by $D_1$. The drilling fluid then circulates through a cross-sectional area of the venturi portion 386 that is defined by $D_2$ to increase in velocity. Subsequent to dissolution, erosion, or otherwise removal of the threaded portion 382, the venturi portion 386 of the nozzle 380 also drops out of the fluid pathway 210 (as it is no longer coupled to the fluid pathway 210). During a lost circulation operation, in which lost circulation material is added to the drilling fluid, and drilling fluid with lost circulation material is circulated through the cross-sectional area of the first portion 222 (at diameter, $D_1$) and then a cross-sectional area of the second portion 224 of the fluid pathway 210, which being defined by the diameter, $D_3$. As shown, $D_3$ is larger than $D_1$. Therefore, while the drilling fluid exit velocity decreases, the lost circulation material added to the drilling fluid better and more easily exits the wellbore drill bit 200 (relative to the nozzle 380 prior to dissolution, erosion, or removal of the threaded portion 382).

Example materials for the threaded portion 382 may include metal alloys or plastics. Metal alloys may include, for example, magnesium, aluminum, or other metals that may dissolve or erode in the presence of, for example, acid as an additive to the drilling fluid. Other example additives include brine, potassium chloride, or other high chloride liquids. In some aspects, the choices of nozzle material and additive may be selected so that contact between nozzle material and drilling fluid additive creates a Galvanic reaction or otherwise causes rapid dissolution of the material.

In some aspects, the nozzle 380 shown in FIG. 3C may be used for wellbores that require a relatively high drilling mud density, which results in a high density of solids. For example, as the venturi portion 386 is made of un-dissolvable material relative to the threaded portion 382, the venturi portion 386 can withstand high drilling fluid erosional velocity associated with the high density drilling fluid. Once the additive is added to the drilling fluid and dissolves or erodes the threaded portion 382, the remaining portions of the nozzle 380 drop out of the wellbore drill bit 200. For instance, in relatively deep sections of a wellbore that is being formed, a high drilling fluid density may be required (for example, a drilling fluid with a higher solid percentage). These solids pose a risk to dissolving or otherwise eroding the portion of the nozzle 380. Thus, in this example, having the threaded portion 382 be the removable portion may allow for a greater ability for the nozzle 380 to withstand the denser (relatively) drilling fluid before it is determined that an activation fluid should be circulated to remove the threaded portion 382 (thereby causing the nozzle 380 to drop from the drill bit 200).

In an example operation of any one of nozzles 300, 350, or 380, drilling fluid may be circulated through a drill string and into a wellbore drill bit that includes the nozzle during a normal drilling operation. During normal drilling operations, the nozzle in the wellbore drill bit may function to increase a velocity of the drilling fluid as it exits the drill bit.

If, at some point during drilling operations, lost circulation of the drilling fluid is detected (for example, based on decreased pressure in the wellbore), it may be determined that a lost circulation operation should commence to introduce lost circulation material into the wellbore to prevent or help prevent drilling fluid from being lost to the formation. Without tripping the wellbore drill bit out of the wellbore, or changing the drill bit or nozzle, an additive is added to the drilling fluid. The additive may be selected or designed to erode, dissolve, or otherwise remove at least a portion of the nozzle (for example, the whole nozzle, a threaded portion of the nozzle, a venturi portion of the nozzle, or other portion of the nozzle). The additive may be circulated with the drilling fluid until the removable portion of the nozzle is removed. This may be determined, for example, by a change in pressure of the additive-drilling fluid mixture in the wellbore.

Upon removal of the portion of the nozzle, the lost circulation material may be added to the drilling fluid and circulated through the drill string, the wellbore drill bit, and the remaining nozzle portion (if any). Thus, lost circulation operations may commence without tripping the drill string or wellbore drill bit out of the wellbore.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method for adjusting a flow of a drilling fluid, comprising:

circulating a drilling fluid in a tubular to a wellbore drill bit that comprises a nozzle positioned in a drilling fluid pathway of the drill bit;

circulating the drilling fluid through the drilling fluid pathway and through the nozzle;

adding a drilling fluid additive to the drilling fluid;

circulating the drilling fluid and the drilling fluid additive through the drilling fluid pathway and through the nozzle; and removing, with the drilling fluid additive, at least a portion of the nozzle that comprises a removable material.

2. The method of claim 1, wherein the nozzle comprises a threaded portion and a venturi portion positioned inside of the threaded portion, and removing, with the drilling fluid additive, at least the portion of the nozzle that comprises the removable material comprises removing at least a portion of the venturi portion.

3. The method of claim 2, further comprising:

circulating the drilling fluid through the drilling fluid pathway and through the threaded portion of the nozzle;

adding a lost circulation material to the drilling fluid; and circulating the drilling fluid and the lost circulation material through the drilling fluid pathway and through the threaded portion of the nozzle.

4. The method of claim 3, further comprising circulating the lost circulation material into the wellbore from the nozzle.

5. The method of claim 4, further comprising prior to adding the lost circulation material to the drilling fluid, detecting a reduction in pressure in the drilling fluid.

6. The method of claim 4, further comprising stopping a loss of drilling fluid to a formation with the lost circulation material circulated into the wellbore.

7. The method of claim 1, wherein the removable material comprises at least one of a metal alloy or a plastic material.

8. The method of claim 7, wherein the metal alloy comprises at least one of magnesium or aluminum.

9. The method of claim 1, wherein the drilling fluid additive comprises at least one of an acid, a brine, or a chloride fluid.

10. The method of claim 1, wherein the drilling fluid pathway comprises a first diameter portion defined by a first diameter and a second diameter portion defined by a second diameter that is larger than the first diameter.

11. The method of claim 10, wherein the first diameter portion comprises an inlet of the drilling fluid pathway, and the second diameter portion comprises an outlet of the drilling fluid pathway.

12. The method of claim 10, wherein the second diameter portion comprises a grooved surface configured to receive a threaded portion of the nozzle.

13. The method of claim 12, wherein the nozzle comprises a venturi portion and the threaded portion, and removing, with the drilling fluid additive, at least the portion of the nozzle that comprises the removable material comprises removing the threaded portion with the drilling fluid additive.

14. The method of claim 12, wherein the nozzle comprises a venturi portion and the threaded portion, and removing, with the drilling fluid additive, at least the portion of the nozzle that comprises the removable material comprises removing the venturi portion with the drilling fluid additive.

15. The method of claim 12, wherein the nozzle comprises a venturi portion and the threaded portion, removing, with the drilling fluid additive, at least the portion of the nozzle that comprises the removable material comprises removing the threaded portion and the venturi portion with the drilling fluid additive.

16. The method of claim 1, further comprising circulating the drilling fluid additive, within the drilling fluid, through the nozzle and into a wellbore.

* * * * *